US009428914B2

(12) United States Patent
Partis, Jr.

(10) Patent No.: US 9,428,914 B2
(45) Date of Patent: Aug. 30, 2016

(54) GUTTER CLEANING DEVICE

(71) Applicant: David Partis, Jr., Canyon Country, CA (US)

(72) Inventor: David Partis, Jr., Canyon Country, CA (US)

( * ) Notice: Subject to any disclaimer, the term of this patent is extended or adjusted under 35 U.S.C. 154(b) by 0 days.

(21) Appl. No.: 14/574,734

(22) Filed: Dec. 18, 2014

(65) Prior Publication Data

US 2016/0177571 A1 Jun. 23, 2016

(51) Int. Cl.

| | |
|---|---|
| ***E04D 13/076*** | (2006.01) |
| ***B05B 1/16*** | (2006.01) |
| ***B05B 13/06*** | (2006.01) |
| ***B05B 15/06*** | (2006.01) |
| ***B08B 3/02*** | (2006.01) |

(52) U.S. Cl.

CPC ..... *E04D 13/0765* (2013.01); *B05B 1/16* (2013.01); *B05B 13/0627* (2013.01)

(58) Field of Classification Search

CPC ..... E04D 13/0765; B05B 1/02; B05B 1/12; B05B 1/14; B05B 1/16; B05B 13/06272; B05B 15/06; B05B 15/061; B05B 15/064; B05B 15/068; B08B 3/02; B08B 3/026; B08B 3/028; B08B 9/02; A47L 11/38

See application file for complete search history.

(56) References Cited

U.S. PATENT DOCUMENTS

| | | | | | |
|---|---|---|---|---|---|
| 2,910,711 | A * | 11/1959 | Mizelle | B05B 1/02 | 239/280 |
| 3,023,971 | A | 3/1962 | Milhous | | |
| 3,041,655 | A * | 7/1962 | Entler | E04D 13/0765 | 134/167 R |
| 3,908,910 | A | 9/1975 | Detwiller | | |
| 4,182,497 | A * | 1/1980 | Ferreira | E04D 13/0765 | 134/167 C |
| 4,319,851 | A * | 3/1982 | Arthur | A47L 11/38 | 134/167 C |
| 4,750,883 | A * | 6/1988 | Drake | A47L 11/38 | 134/167 C |
| 4,756,043 | A | 7/1988 | Hazelet | | |
| 5,037,028 | A | 8/1991 | Evans | | |
| 5,386,942 | A * | 2/1995 | Dietle | E04D 13/0765 | 239/532 |
| 5,390,853 | A | 2/1995 | Ellul | | |
| 5,725,322 | A | 3/1998 | Evans | | |
| 5,727,580 | A * | 3/1998 | Patterson | E04D 13/0765 | 134/115 R |
| 5,875,590 | A | 3/1999 | Udelle | | |
| 5,988,715 | A * | 11/1999 | Mason | E04D 13/0765 | 15/236.04 |
| D443,961 | S | 6/2001 | McKnight | | |
| 6,257,256 | B1 | 7/2001 | Fischer | | |
| 6,976,644 | B2 | 12/2005 | Troudt | | |
| 8,919,672 | B2 * | 12/2014 | Chen | B05B 1/267 | 239/280.5 |
| 2009/0127349 | A1 * | 5/2009 | DeLeo | E04D 13/0765 | 239/1 |

* cited by examiner

*Primary Examiner* — Darren W Gorman

(57) ABSTRACT

A gutter cleaning assembly for PURPOSE includes a first pipe coupled to a fluid source. The first pipe is structured to have an inverted J-shape such that the first pipe positionable within a gutter. A valve is coupled to the first pipe. The valve selectively allows or restricts a flow of the fluid through the first pipe. A second pipe is coupled to the first pipe. The second pipe is structured to have an L-shape such that the second pipe directs the flow of the fluid into the gutter. A plurality of spray heads is each selectively coupled to the second pipe. The spray heads increase a pressure of the flow of the fluid into the gutter so the fluid clears the gutter of debris.

6 Claims, 4 Drawing Sheets

GUTTER CLEANING DEVICE

BACKGROUND OF THE DISCLOSURE

Field of the Disclosure

The disclosure relates to cleaning devices and more particularly pertains to a new cleaning device to remove debris from a gutter.

SUMMARY OF THE DISCLOSURE

An embodiment of the disclosure meets the needs presented above by generally comprising a first pipe coupled to a fluid source. The first pipe is structured to have an inverted J-shape such that the first pipe positionable within a gutter. A valve is coupled to the first pipe. The valve selectively allows or restricts a flow of the fluid through the first pipe. A second pipe is coupled to the first pipe. The second pipe is structured to have an L-shape such that the second pipe directs the flow of the fluid into the gutter. A plurality of spray heads is interchangeably coupled to the second pipe. Each of the spray heads increases a pressure of the flow of the fluid into the gutter so the fluid clears the gutter of debris.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
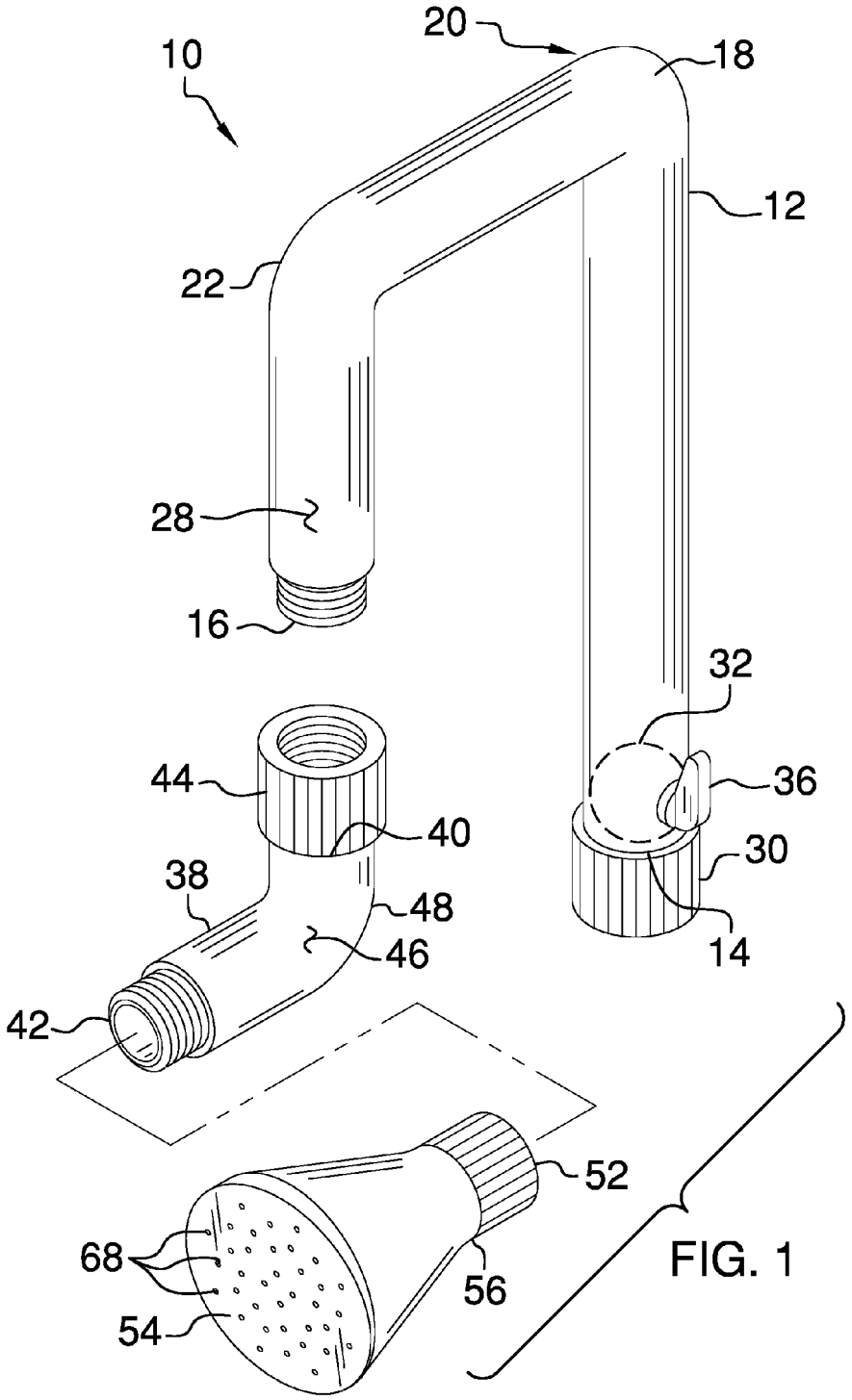
FIG. 1 is a perspective view of a gutter cleaning assembly according to an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the gutter cleaning assembly 10 generally comprises a first pipe 12. The first pipe 12 has a first end 14 and a second end 16. The first pipe 12 has a first bend 18 positioned proximate a center 20 of the first pipe 12. Additionally, the first pipe 12 has a second bend 22 positioned between the first bend 18 and the second end 16 of the first pipe 12 such that the first pipe 12 has an inverted J-shape.

Thus, the first pipe 12 is positionable to direct the second end 16 into a gutter 24. The gutter 24 may be a roof gutter or the like. The first end 14 of the first pipe 12 is fluidly coupled to a fluid source 26. The fluid source 26 may be a water hose or the like.

An outer surface 28 of the first pipe 12 is threaded proximate the second end 16 of the first pipe 12. A first coupler 30 is coupled to the second end 16 of the first pipe 12. The first coupler 30 engages the fluid source 26 so the first pipe 12 is fluidly coupled to the fluid source 26.

A valve 32 is coupled to the first pipe 12. The valve 32 is positioned within the first pipe 12. Additionally, the valve 32 is positioned proximate the first end 14 of the first pipe 12. The valve 32 alternately allows and restricts a flow of a fluid 34 through the first pipe 12. A handle 36 is coupled to the valve 32. The handle 36 is positioned proximate the outer surface 28 of the first pipe 12 such that said handle 36 is accessible. The handle 36 is manipulated to position the valve 32 between an open position and a closed position.

A second pipe 38 is provided. The second pipe 38 has a primary end 40 and a secondary end 42. A second coupler 44 is coupled to the primary end 40. The second coupler 44 threadably engages the second end 16 of the first pipe 12. Thus, the second pipe 38 is fluidly coupled to the first pipe 12. An outermost surface 46 of the second pipe 38 is threaded proximate the secondary end 42.

The second pipe 38 has a primary bend 48. The primary bend 48 is positioned closer to the primary end 40 than the secondary end 42 such that the second pipe 38 has an L-shape. Thus, the second pipe 38 directs the flow of the fluid 34 into the gutter 24 at a selected direction with respect to the gutter 24. The second pipe 38 swivels relative to the first pipe 12.

A plurality of spray heads 50 is provided. The spray heads 50 each has a coupled end 52 and a free end 54. The coupled end 52 of a selected one of the spray heads 50 threadably engages the secondary end 42 of the second pipe 38. Thus, the selected one of the spray heads 50 is fluidly coupled to the secondary end 42 of the second pipe 38 such that the fluid 34 flows into the selected spray head 50.

The free end 54 of the each of the spray heads 50 is open. Thus, the flow of the fluid 34 is directed outwardly from the free end of each of the spray heads 50. The spray head 50 increases a pressure of the flow of the fluid 34 into the gutter 24. The fluid 34 clears the gutter 24 of debris. The debris may be organic material or the like that collects in the gutter 24 over time.

The plurality of spray heads 50 include a full shower spray head 56, a half shower spray head 58, a minimum pressure spray head 60, a medial pressure spray head 62, a full pressure spray head 64 and a fan spray head 66. The respective free end 54 of the each of the full shower spray head 56 and half shower spray head 58 lie on a plane that is angular with respect to the respective coupled end 52 of the full shower spray head 56 and the half shower spray head 58. The free end 54 of the full shower spray head 56 and the half shower spray head 58 may lie at angle between 15° and 25° with respect the coupled end 52 of the full shower spray head 56 and half shower spray head 58. The free end 54 of each of the full shower spray head 56 and half shower spray head 58 each has a plurality of fluid apertures 68 extending therethrough.

The free end 54 of the full shower spray head 56 has a diameter that is greater than a diameter of the coupled end 52 of the full shower spray head 56. The free end 54 of the half shower spray head 58 is bisected such that said free end 54 of the half shower head 58 has a semi-circular shape. The free end 54 of the fan spray head 66 is flattened. The fan spray head 66 generates a wide distribution of the fluid.

The respective free end 54 of each of the minimum pressure spray head 60, the medial pressure spray head 62 and the full pressure spray head 64 has a diameter that is less than a diameter of the respected coupled end 52 of the minimum pressure spray head 60, the medial pressure spray head 62 and the full pressure spray head 64. The free end 54 of the full pressure spray 64 head has a diameter that is less than a diameter of each of the respected free end 54 of each of the medial pressure spray head 62 and minimum pressure spray head 60. The full pressure spray head 64 generates a maximum pressure of the flow of the fluid 34. The free end 54 of the medial pressure spray head 62 has a diameter that is between the diameter of the respective free end 54 of the full pressure spray head 64 and the minimum pressure spray head 60. The medial pressure spray head 62 generates a medium pressure of the flow of the fluid 34. The free end 54 of the minimum pressure spray head 60 has a diameter that is greater than the diameter of the respective free end 54 of the full pressure spray head 64 and medial pressure spray head 62. The minimum pressure spray head 60 generates a minimum pressure of the flow of the fluid 34.

An extension pole 69 is provided. A sleeve 70 is provided. A pair of brackets 72 is coupled to the sleeve 70. Each of the brackets 72 engages the first pipe 12 between the first bend 18 and the first end 14 of the first pipe 12. Thus, the sleeve 70 is retained on the first pipe 12. The extension pole 69 threadably engages the sleeve 70. The extension pole 69 allows the first pipe 12, the second pipe 38 and the selected spray head 50 to be positioned into a gutter 24 that is elevated to an unaccessible height.

Figure 2:
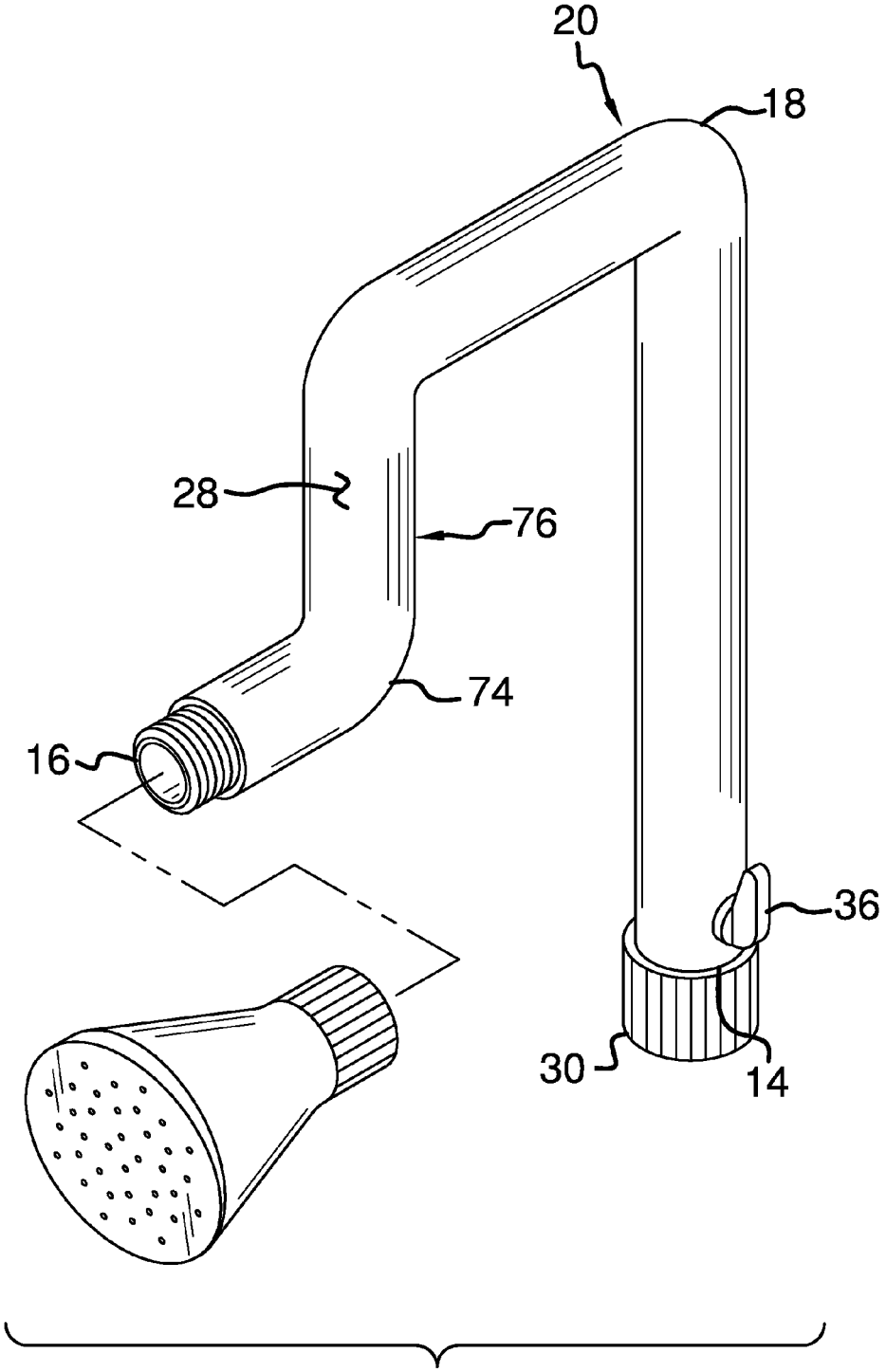
FIG. 2 is a perspective view of an alternative embodiment of the disclosure.
Figure 4:
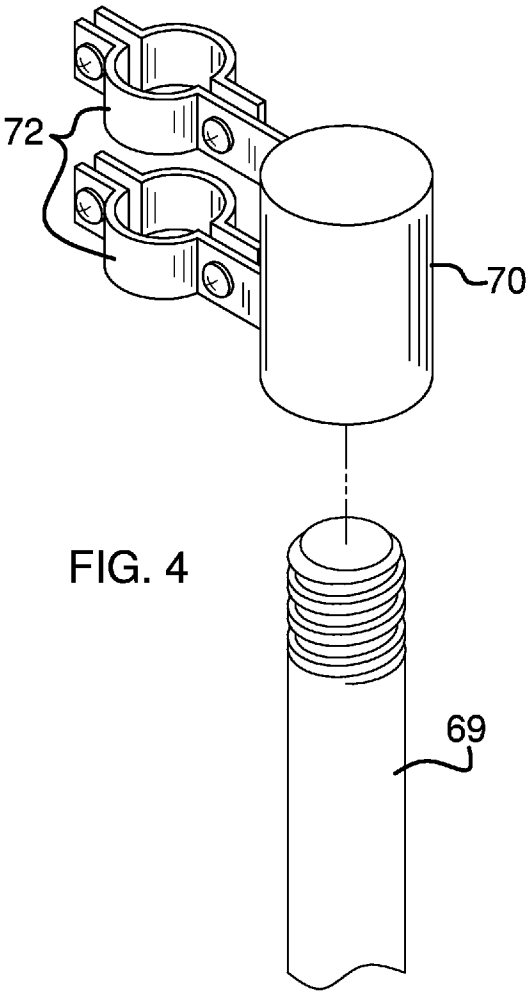
FIG. 4 is a top perspective view of an embodiment of the disclosure.
Figure 3:
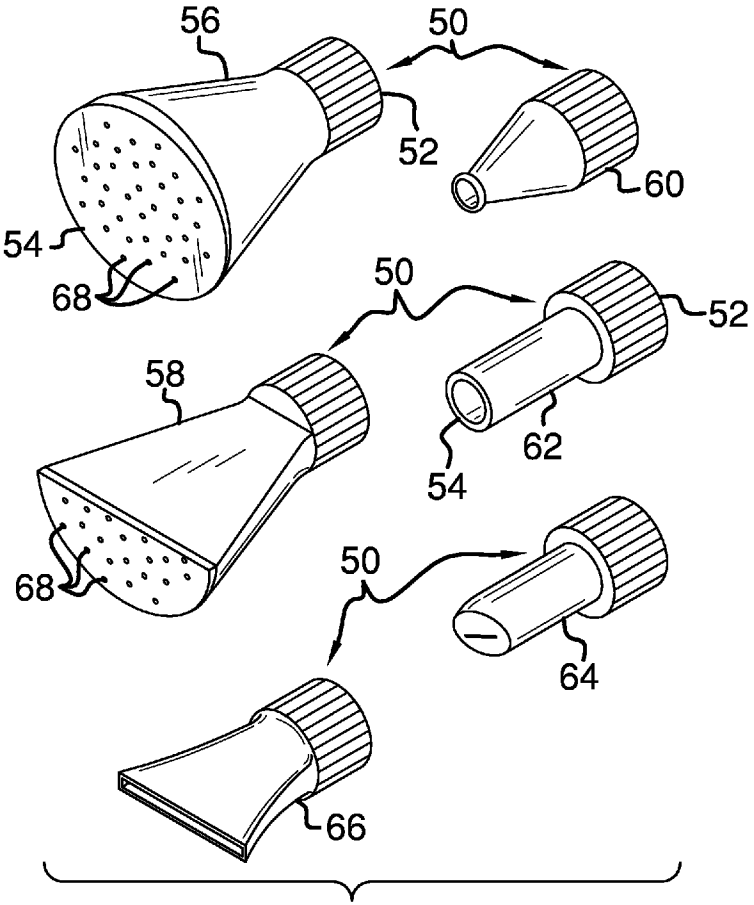
FIG. 3 is a front perspective view of an embodiment of the disclosure.
Figure 5:
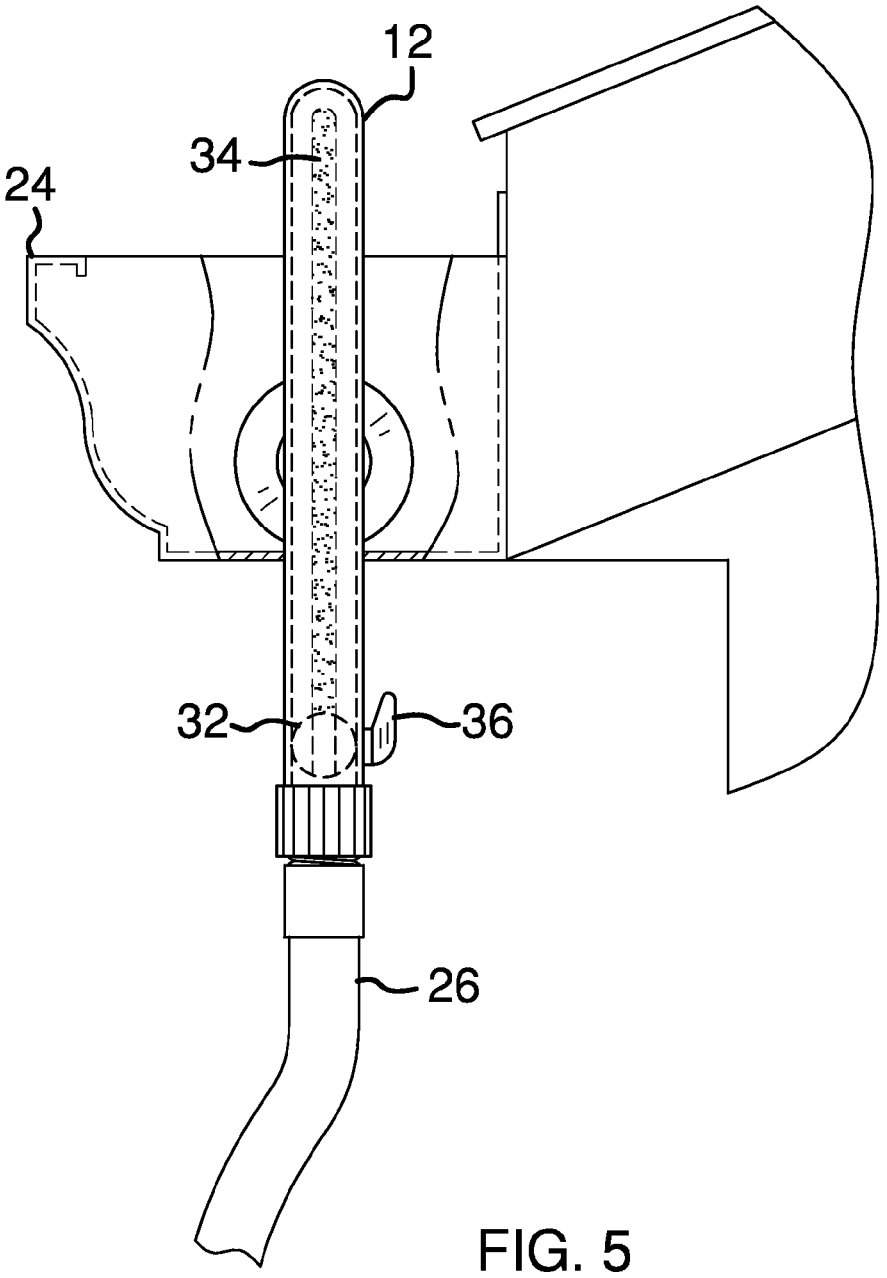
FIG. 5 is an in-use view of an embodiment of the disclosure.

In an alternative embodiment as shown in FIG. 2, the first pipe 12 may have a third bend 74 positioned between the second bend 22 and the second end 16 of the first pipe 12 to define a medial section 76 of the first pipe 12. The third bend 74 directs the second end 16 forwardly away from the medial section 76 of the first pipe 12. The third bend 74 on the first pipe 12 replaces the second pipe 38.

In use, the assembly 10 is positioned in the gutter 24 so the selected spray head 50 directs the flow of the fluid 34 longitudinally along the gutter 24. The fluid 34 sprayed outwardly from the free end 54 of selected spray head 50 urges the debris along a length of the gutter 24. The debris is subsequently removed from the gutter 24 to promote unrestricted performance of the gutter 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gutter cleaning device comprising:

a first pipe configured to be coupled to a fluid source, said first pipe being structured to have an inverted J-shape such that said first pipe is configured to be positioned within a gutter;

a valve coupled to said first pipe such that said valve is configured to alternatively allow and restrict a flow of the fluid through said first pipe;

a second pipe being coupled to said first pipe, said second pipe being structured to have an L-shape such that said second pipe is configured to direct the flow of the fluid into the gutter;

a plurality of spray heads is interchangeably coupled to said second pipe such that said spray heads are configured to increase a pressure of the flow of the fluid into the gutter wherein fluid clears the gutter of debris;

a pair of spaced brackets coupled to and extending perpendicularly from a sleeve, each of said spaced brackets being couplable to said first pipe wherein said sleeve is attached to said first pipe in parallel spaced relationship to said first pipe; and an extension pole couplable to said sleeve, said extension pole being linearly aligned with said sleeve wherein said extension pole is offset from said first pipe.

2. The device according to claim 1, wherein said first pipe has a first end and a second end, said first pipe having a first bend positioned proximate a center of said first pipe, said first pipe having a second bend positioned between said first bend and said second end of said first pipe wherein said first pipe is configured to be positioned to direct said second end into the gutter, said first end of said first pipe being fluidly coupled to the fluid source.

3. The device according to claim 2, wherein said second pipe has a primary end and a secondary end, said primary end being fluidly coupled to said second end of said first pipe, said second pipe having a primary bend being positioned closer to said primary end than said secondary end such that said second pipe is configured to direct the flow of fluid in a selected direction with respect to the gutter.

4. The device according to claim 3, wherein each of said spray heads has a coupled end and a free end, said coupled end of a selected one of said spray heads being fluidly coupled to said secondary end of said second pipe such that the fluid flows into said selected spray head, said free end of said spray heads each being open such that the flow of the fluid is directed outwardly from said free end of said spray heads.

5. The device according to claim 4, wherein said plurality of spray heads includes a full shower spray head, a half shower spray head, a minimum pressure spray head, a medial pressure spray head, a full pressure spray head and a fan spray head.

6. A gutter cleaning device comprising:

a first pipe, said first pipe having a first end and a second end, said first pipe having a first bend positioned proximate a center of said first pipe, said first pipe having a second bend positioned between said first bend and said second end of said first pipe such that said first pipe has an inverted J-shape wherein said first pipe is configured to be positioned to direct said second end into a gutter, said first end of said first pipe being fluidly coupled to a fluid source;

a valve coupled to said first pipe such that said valve is configured to alternately allow and restrict a flow of the fluid through said first pipe;

a second pipe, said second pipe having a primary end and a secondary end, said primary end being fluidly coupled to said second end of said first pipe, said second pipe having a primary bend being positioned closer to said primary end than said secondary end such that said second pipe has an L-shape wherein said second pipe is configured to direct the flow of fluid into the gutter at a selected direction with respect to the gutter;

a plurality of spray heads, said spray heads each having a coupled end and a free end, said coupled end of a selected one of said spray heads being fluidly coupled to said secondary end of said second pipe such that the fluid flows into said selected spray head, said free end of said spray heads each being open such that the flow of the fluid is directed outwardly from said fluid apertures, said spray heads being configured to increase a pressure of the flow of the fluid in the gutter wherein the fluid clears the gutter of debris;

said plurality of spray heads including a full shower spray head, a half shower spray head, a minimum pressure spray head, a medial pressure spray head, a full pressure spray head and a fan spray head;

a pair of spaced brackets coupled to and extending perpendicularly from a sleeve, each of said spaced brackets being couplable to said first pipe wherein said sleeve is attached to said first pipe in parallel spaced relationship to said first pipe; and an extension pole couplable to said sleeve, said extension pole being linearly aligned with said sleeve wherein said extension pole is offset from said first pipe.

* * * * *